US006329891B1

(12) United States Patent
Hayashi et al.

(10) Patent No.: US 6,329,891 B1
(45) Date of Patent: Dec. 11, 2001

(54) HIGH FREQUENCY RELAY

(75) Inventors: Tokatoshi Hayashi, Suzuka; Atsushi Nakahata, Matsusaka; Takuji Yamashita, Higashiosaka; Hidetoshi Takeyama, Hisai; Koji Sagawa, Tsu; Tetsuya Yamada; Tomohiro Taguchi, both of Watarai-gun; Hisao Yabu, Osaka, all of (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 09/717,385

(22) Filed: Nov. 22, 2000

(30) Foreign Application Priority Data

| | | |
|---|---|---|
| Nov. 25, 1999 | (JP) | 11-335129 |
| Nov. 25, 1999 | (JP) | 11-335130 |
| May 26, 2000 | (JP) | 12-157455 |
| Jun. 27, 2000 | (JP) | 12-191976 |

(51) Int. Cl.[7] ..... H01H 53/00; H01H 13/00; H01H 19/00

(52) U.S. Cl. ..... 335/4; 200/305

(58) Field of Search ..... 335/4, 5, 78; 333/262; 200/305

(56) References Cited

U.S. PATENT DOCUMENTS 4,496,806 * 1/1985 Maenishi et al. ..... 200/16 R
6,100,606 8/2000 Nakahata et al. ..... 307/91

* cited by examiner

*Primary Examiner*—Ramon M. Barrera
(74) *Attorney, Agent, or Firm*—Rader, Fishman & Grauer, PLLC

(57) ABSTRACT

A high frequency relay capable of effectively shielding a signal path, yet reducing a number of the parts forming the shield and the associated structure. The relay has a dielectric base mounting three fixed contacts arranged in a line and defined at upper ends of three contact terminals extending through the base. Two movable contact springs are utilized, each bridging the two adjacent fixed contacts for closing and opening a high frequency signal path between the two adjacent fixed contacts. Upstanding from the base is a pair of electromagnetic shield plates which define a shielded space therebetween for accommodating the three fixed contacts and the two movable contact springs. Each of the shield plates is configured to come into electrical contact with corresponding one of the movable contact springs moved in the contact opening position. Each shield plate is integrally formed with at least one ground terminal which extends continuously from a bottom of the shield plate through the base, and each shield plate is configured to cover the first and second movable contact springs over the full length thereof for completely shielding the high frequency signal path.

24 Claims, 10 Drawing Sheets

71
70
71
50
53
56
57
52
58
54
57
18
68
64
62
60
64
32
62
40
31
41
66
26
42
41
23
25
22
24
2
21
8
3
6
1
5
7
2

HIGH FREQUENCY RELAY

BACKGROUND OF THE INVENTION

1. Field of the Invention

The present invention relates to a high frequency relay for switching high frequency signals.

2. Description of the Prior Art

U.S. Pat. No. 6,100,606 discloses a high frequency relay which is contemplated to effectively shield an electric path carrying a high frequency signal. The relay includes three fixed contacts which are mounted on a relay base to define a common (COM) contact, a normally-open (NO) contact, and a normally-closed (NC) contact. A first movable contact spring bridges the COM contact and the NO contact to open and close a first signal path defined between the contacts, while a second movable contact spring bridges the COM contact and the NC contact to open and close a second signal path defined between the contacts. The first and second movable contacts are supported respectively by props extending from a movable part to be movable between contact closing and opening positions, respectively. The relay includes an electromagnetic shield upstanding from the base to surround the three fixed contacts as well as the movable contact springs. The shield is formed in its wall with notches which allow the props to extend through the shield for driving the movable contact springs between the contact closing and opening positions within the confine of the shield. However, due to the presence of the notches, the movable contact springs are exposed through the notches and cannot be fully surrounded by the shield, lowering a high frequency characteristic of the relay. Further, in this patent, the ground terminals are formed separately from the shield and are connected thereto. Thus, the ground terminals have to be prepared in addition to the shield, increasing the number of parts with an associated assembly cost increase.

SUMMARY OF THE INVENTION

The present invention has been achieved in view of the above insufficiencies to provide an improved high frequency relay which is capable of effectively shielding a high frequency signal path, yet reducing a number of the parts forming the electromagnetic shield and the associated structure. The relay in accordance with the present invention includes a dielectric base mounting three fixed contacts defining a common (COM) contact, a normally-closed (NC) contact, and a normally-open (NO) contact, respectively. The NC and NO contacts are arranged on opposite of the COM contact, and each of the fixed contacts is defined at a tip of each corresponding one of three contact terminals extending through the base. A first movable contact spring is disposed to bridge the COM contact and the NC contact for closing and opening a high frequency signal path defined therebetween. Likewise, a second movable contact spring is disposed to bridge the COM contact and the NO contact for closing and opening another high frequency signal path defined therebetween. The relay further includes a driving mechanism which causes the first and second movable contact springs to move for closing and opening the high frequency signal paths alternately. Also included in the relay is a pair of electromagnetic shield plates upstanding from the base to define a shielded space between the shield plates for accommodating therein the three fixed contacts, the first and second movable contact springs. Each of the shield plates is configured to come into electrical contact with corresponding one of the first and second movable contact springs moved in the contact opening position. Each of the shield plates is integrally formed with at least one ground terminal which extends continuously from a bottom of the shield plate through the base, and each shield plate is configured to cover the first and second movable contact springs over the full length thereof without any interruption for completely shielding the first and second high frequency signal paths. Accordingly, the high frequency signal paths can be completely shielded simply by use of the two shield plates integrally formed with the ground terminals.

Preferably, the shield plates are of the identical configuration in order to reduce the number of parts and therefore improve productivity of the relay.

The base may be molded to have a pair of integral positioning studs which project on the base for abutting against opposite ends of the shield plates, respectively so as to accurately keep the spacing between the shield plates for giving an intended high frequency characteristic to the signal path.

Each shield plate is preferably formed with a bent recess which defines grounding shoulders at opposite bent ends of the recess for contact with the opposite ends of each corresponding one of the first and second movable contact springs. The grounding shoulder is located outwardly of an inner edge of the corresponding fixed contact with respect to a lengthwise direction of the corresponding movable contact spring. With this result, the movable contact spring can have its opposite ends rested on the shoulder only with a small projection towards the fixed contact, thereby improving isolation of the movable contact spring from the fixed contact.

Further, the opposite ends of each movable contact spring may be located at outer edges of the corresponding fixed contacts, respectively with respect to the lengthwise direction of the movable contact spring, for minimizing the projection of the opposite ends of the movable contact spring towards the fixed contact when the movable contact is in the contact opening position.

In a preferred embodiment, the shield plate has a pair of the ground terminals which are spaced along a length of the shield plate and positioned asymmetrically about a longitudinal center of the shield plate such that the two ground terminals of one shield plate stagger with respect to the two ground terminal of the other shield plate along the longitudinal direction of the shield plate. With this arrangement, a distance between either of the longitudinal ends of the shield plate and the adjacent ground terminal can be shorted sufficiently with respect to a wavelength of the high frequency signal, thereby avoiding an antenna effect which would otherwise occur between the longitudinal end of the shield plate and the adjacent ground terminal, while utilizing the shield plate of the identical configuration.

In this connection, the two spaced ground terminals are configured to extend from the bottom of the shield plate through respective anchor sections which are engaged with the base and have a greater width than the ground terminal with respect to the lengthwise direction of the shield plate. One of the anchor sections adjacent to the contact terminal of the COM contact is spaced therefrom by a distance greater than a distance by which another of the anchor sections adjacent to the contact terminal of the NC or NO contact is spaced therefrom. With this result, it is possible to reduce a capacitance between the contact terminal of the COM contact and the two adjacent ground terminal than a capacitance between the contact terminal of the NC or NO contact and the one adjacent ground terminal, thereby facilitating to achieve an impedance matching of the high frequency signal path to an intended overall impedance.

The driving mechanism of moving the first and second movable contact springs includes an electromagnet, an armature, and a card carrying the first and second movable contact springs at its lower end. The armature moves in response to the excitation of the electromagnet for driving the card to open and close the high frequency signal paths. The card is shaped into an elongated configuration aligned along the length of the shield plate and is located above the shield space. The card is formed at its upper longitudinal ends with pivot arms which are pivotally supported on top of end walls upstanding from opposite longitudinal ends of the base. Thus, the card can swing about a pivot axis which is fixed vertically relative to the base. With this result, the card can move the movable contact springs accurately while keeping the movable contact sprigs only at a small distance from the base. Accordingly, the height of the contact terminals projecting from the base within the shield space can be shortened and be easy to project straight, thereby facilitating to give an intended high frequency characteristic to the relay. The pivot arm is preferably configured to have a rounded fulcrum which rests on a flat surface on top of the end wall.

The card may be also formed at its opposite longitudinal ends with retainer members which are engaged respectively with the end walls to retain the card at a correct position for defining a constant pivot axis about which the card pivots. The retainer member may be shaped into a spindle having a uniform diameter and received in a bearing recess at the upper end of the end wall in rolling contact with opposite side walls of the bearing recess. The opposite side walls are spaced by a distance equal to the diameter of the spindle. Thus, the pivot axis of the card can be fixed also horizontally for assuring a precise pivotal movement of the card and therefore a reliable contact opening and closing.

Further, the relay may include a cover fitted over the base to enclose various components of the relay. The cover has a top wall of which interior surface is formed with at least one projection which engages into at least one pivot catch. The pivot catch is formed in the card for pivotally supporting the card about the pivot axis. Thus, the card can pivot successfully to assure reliable contact closing and opening even when the relay is installed upside down.

The relay is further equipped with a return spring which urges the card in a direction of disengaging the second movable contact spring away from the COM contact and the NO contact. The return spring abuts at its one end against the card at the same point along the length of the card as the armature abuts against the card for causing the card to pivot, thereby ensuring a balanced movement of the card and therefore reliable contact closing and opening.

Each of the contact terminals and the ground terminals may be configured to be capable of being bent at a bent point outwardly of the base for enabling the relay to be surface mounted on a circuit board with a bent portion soldered on the circuit board. Each of these terminals is also shaped to have the same cross section from the bent point towards the lower end away from the base. Thus, these terminals can be uniformly bent in such a way as to leave a constant height from the circuit board to the bent portion of the terminals, thereby assuring an accurate surface-mounting of the relay on the circuit board. The ground terminal extends from the bottom of the shield plate through an anchor section which engages with the base and has a greater width than the ground terminal with respect to a lengthwise direction of the shield plate. The anchor section is bent at a right angle from the bottom of the shield plate to extend vertically downwardly therefrom. Thus, the ground terminal can be easy to bent along a wide dimension of the anchor section for accurately projecting the ground terminal downwardly.

Each of the movable contact springs may have a section of which shape is different from that of the remainder of the movable contact spring for making impedance matching of the high frequency signal paths. In the preferred embodiment, each movable contact spring has its lengthwise center portion embedded within a prop which is molded from a plastic material to depend from the card. The movable contact spring is shaped to have a uniform thickness and a width except for the lengthwise center portion which defines the above section responsible for making the impedance matching. Thus, the impedance matching can be made only at the section embedded in the prop in consideration of the capacitance of the prop.

Preferably, the movable contact spring is shaped to have straight upper and lower edges except for said lengthwise center portion. The lengthwise center portion is shaped to have a raised upper edge to increase the width of said lengthwise center portion. Thus, the movable contact spring can be positioned only at a small distance from the base for facilitating to give the desired high frequency characteristic to the relay.

The electromagnet includes an excitation coil wound around a center core, and a yoke disposed outwardly of the coil to establish a magnetic flux path together with the armature. In the preferred embodiment, the yoke is configured to have a yoke extension projecting on the bottom surface of the base, while the shield plate is also shaped to have a shield extension projecting on the bottom of the base for electrical connection with the yoke extension on the bottom of the base. Thus, the yoke of an electrical conductive member can be successfully coupled electrically to the shield for preventing possible leakage of the high frequency signal and therefore assuring good isolation characteristic of the relay. The shield extension may be formed closely adjacent to the ground terminal for further improving the isolation characteristic. The shield extension is electrically connected to the yoke extension by means of an electrically conductive adhesive for easy electrical connection therebetween. In this connection, the base may be formed with grooves extending between the shield extension and the yoke extension for receiving the electrically conductive adhesive.

Preferably, the base is formed with barriers on the bottom of the base to separate the grooves from the contact terminals for secluding the electrically conductive adhesive filled in the groove from a sealing agent filled around the contact terminals concurrently or immediately after the application of the adhesive. Thus, the electrically conductive adhesive and the sealing agent can be applied and cured almost simultaneously on the bottom of the base, yet without being intermingled with each other. Preferably, the electrically conductive adhesive include a silver paste for enabling the curing at a relatively low temperature without giving heat damage to the components of the relay.

These and still other objects and advantageous features of the present invention will become more apparent from the following detailed description of the preferred embodiment of the present invention when taken in conjunction with the attached drawings.

DETAILED DESCRIPTION OF THE EMBODIMENT

Figure 1:
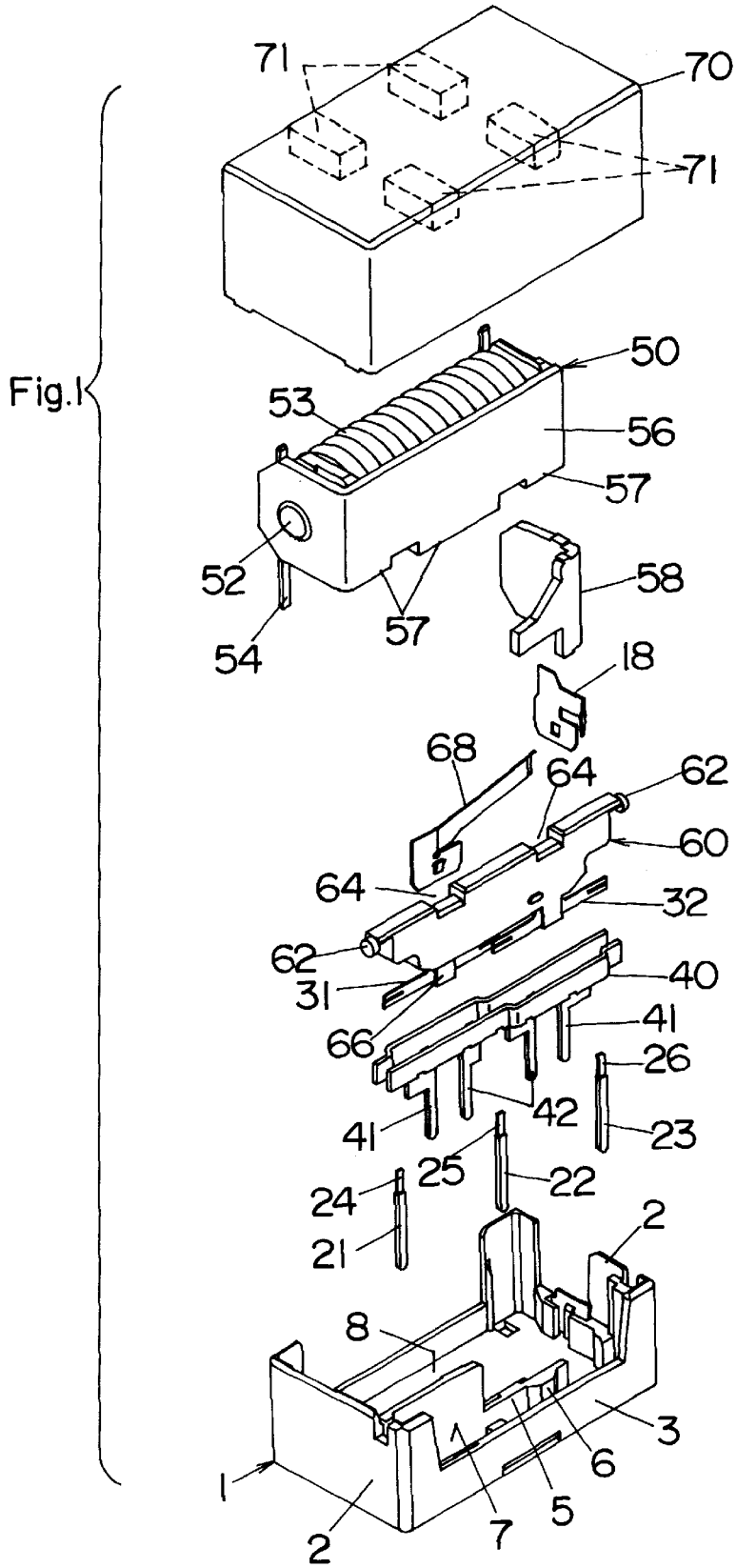
FIG. 1 is an exploded perspective view of a high frequency relay in accordance with a preferred embodiment of the present invention.
Figure 8:
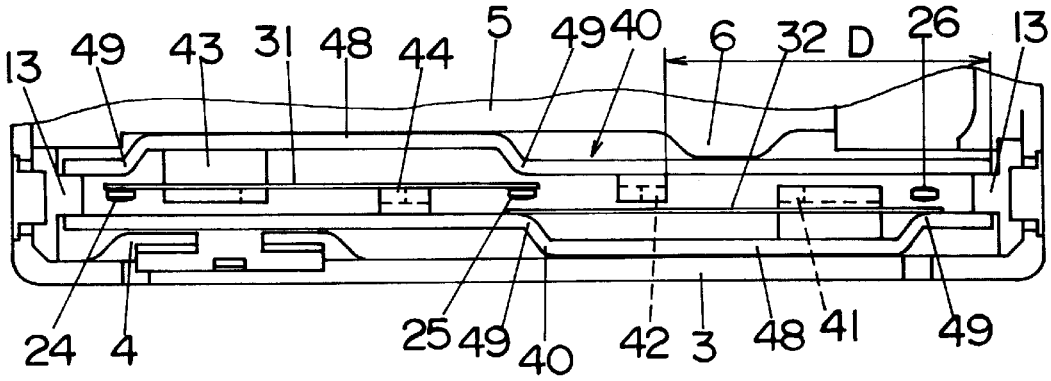
FIG. 8 is a top view of a contact block and an electromagnetic shield thereof utilized in the relay.

Referring now to FIG. 1, there is shown a high frequency relay in accordance with a preferred embodiment of the present invention. The relay is utilized in circuit for switching a high frequency signal of 30 MHz to 3 GHz. The relay includes a dielectric base 1 mounting thereon a shielded contact block and an electromagnet block 50. A cover 70 is fitted over the base 1 to enclose various components of the relay. The contact block is composed of three horizontally spaced contact terminals 21, 22, and 23 each extending through the base 1 and defining a fixed contact 24, 25, and 26 at its upper end, and a pair of movable contact springs 31 and 32 each in the form of a spring leaf of uniform thickness extending horizontally across the two adjacent fixed contacts 24, 25 and 25, 26. The center fixed contact 25 defines a common contact (COM), while the remaining two outer fixed contacts 24 and 26 define normally-open (NO) contact and normally-closed (NC) contact, respectively. The movable contact springs 31 and 32 are driven by the electromagnet block 50 to make two alternate contact positions. In one position which is a set position, as shown in FIG. 8, the left-hand movable contact spring 31 interconnects the two adjacent (COM) and (NO) contacts 25 and 26 for closing a high frequency signal path therebetween, while the right hand movable contact spring 32 is disengaged away from the two adjacent (COM) and (NC) contacts 25 and 26 for opening another high frequency signal path therebetween. In the other position, which is a reset position, the above relation is reversed. The contact block further includes a pair of shield plates 40 formed from an electrically conductive metal sheet to surround the fixed contacts 24 to 26 as well as the movable contact springs 31 and 32 in order to isolate the high frequency signal paths from the electromagnet block 50. The contact block thus shielded is located in an elongated compartment 7 which is formed on one lateral side of the base 1 and is confined by opposite end walls 2 of the base 1, a partition 5, and one of side walls 3 of the base. Another compartment 8 is formed between the partition 5 and the other side wall 3 for accommodating the electromagnet block 50.

Figure 2:
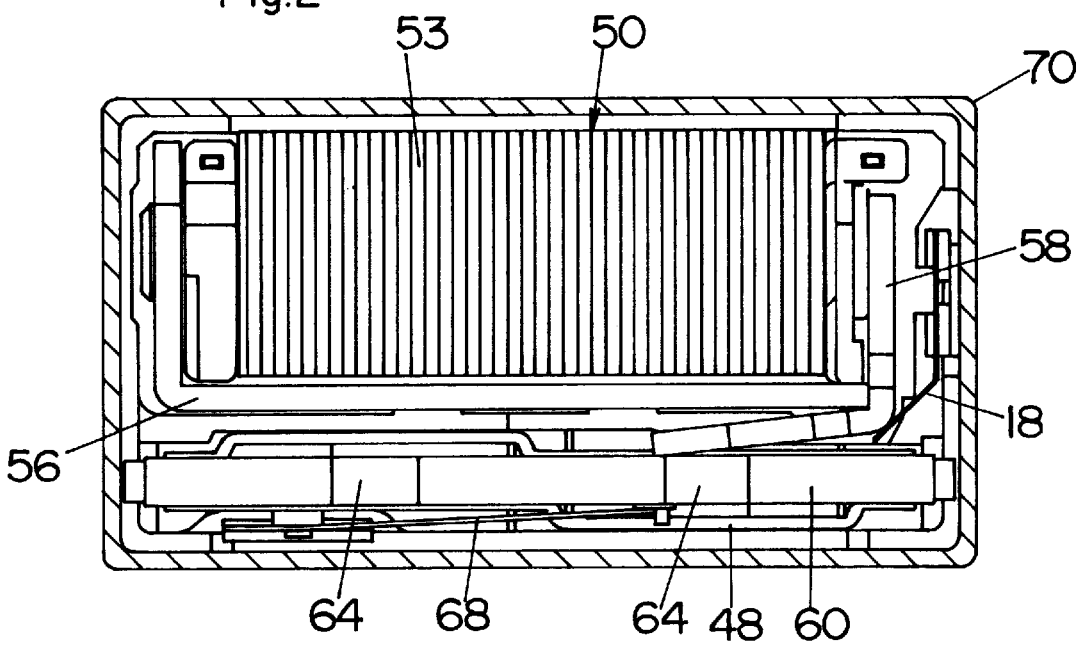
FIG. 2 is a top view of the relay shown with a cover partly removed.

The electromagnet block 50 includes an electromagnet composed of an excitation coil 53 wound about a center core 52, an L-shaped yoke 56, and an L-shaped armature 58. The coil 53 has its opposite ends wired respectively to coil terminals 54 extending through the base 1 for connection with a driving circuit of the relay. As shown in FIG. 2, the armature 58 is pivotally supported at its inside corner to one end of the yoke 56 with the help of a retainer spring 18 to establish a magnetic flux path. When the coil 53 is energized, the armature 58 pivots to have its one end attracted to the center core 52. Upon this occurrence, the armature 58 forces a card 60 carrying the movable contact springs to thereby disengage the one movable contact spring 32 away from the NC and COM contacts 26 and 25 and at the same time engage the other movable contact spring 31 with the COM and NO contacts 25 and 24. Upon deenergization of the coil 53, the armature 58 is returned to an unattracted position by the urgence of a return spring 68 acting on the armature 58 through the card 60. The return spring 68 is in the form of a leaf-spring having its one end secured to the base 1 and having the other end kept pressed against the card 60.

Figure 6:
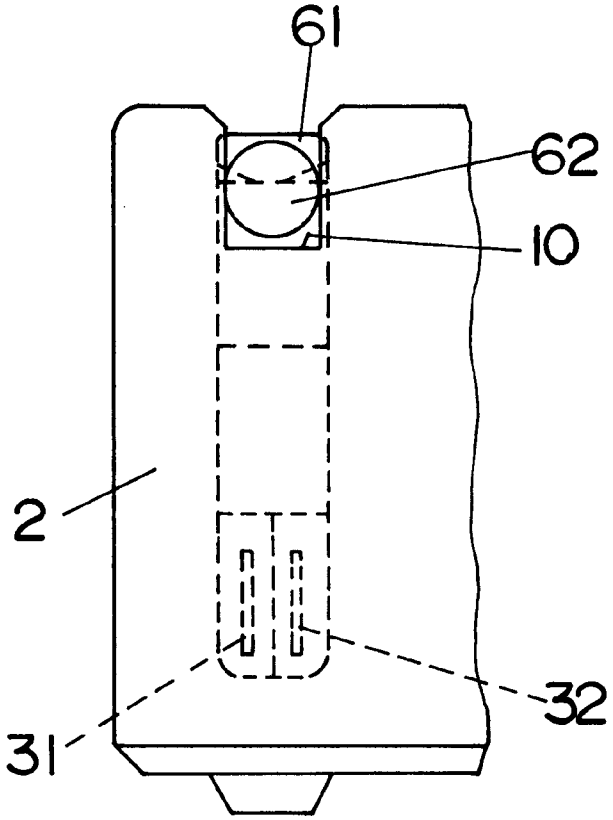
FIG. 6 is a partial side view illustrating the above supporting structure.
Figure 5:
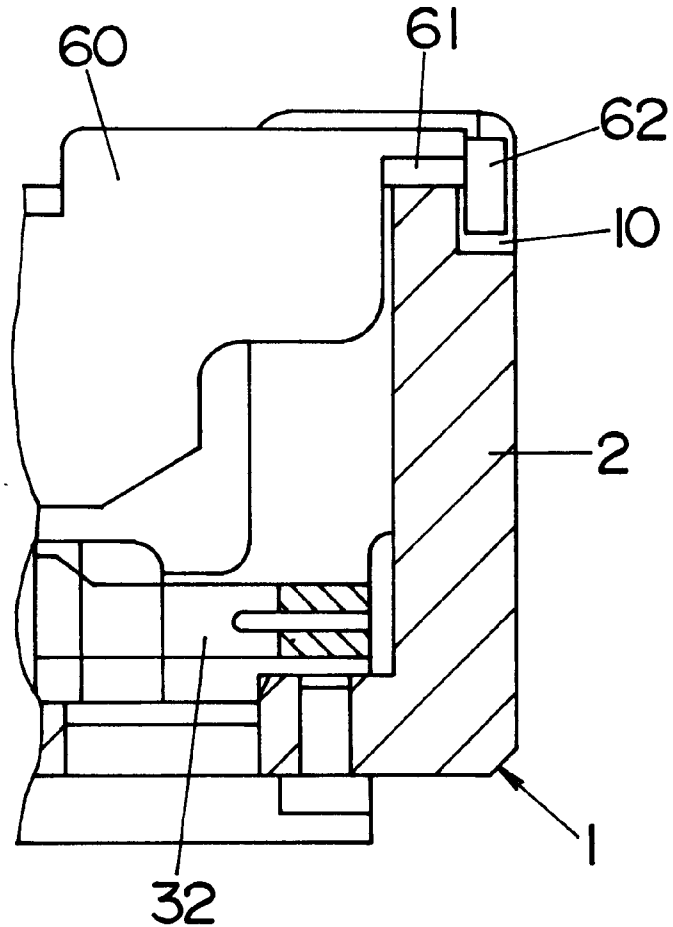
FIG. 5 is a partial front view illustrating a pivotally supporting structure of a card of the relay.
Figure 7:
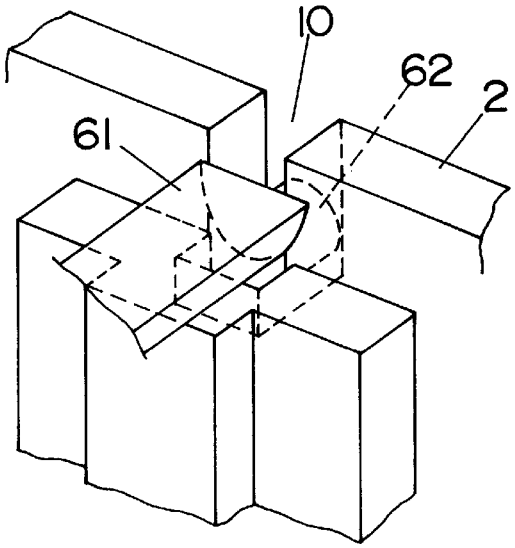
FIG. 7 is a partial perspective view illustrating the above supporting structure.

The card 60 is molded from a dielectric plastic material to have integral pivot arms 61 at its upper longitudinal ends for pivotally supporting the card 60 on top of the opposite end walls 2 upstanding from the base 1 so that the card 60 pivots about a horizontal pivot axis for opening and closing the contacts upon being driven by the armature 58. As best shown in FIGS. 5 to 7, the pivot arm 61 has it's a rounded lower surface resting on a flat top surface of the end wall 2 to define the pivot axis at the interface therebetween. The card 60 is also formed with a pair of spindles 62 each integrally extending from the pivot arm 61 and being fitted into a corresponding bearing recess 10 in the upper end of the end wall 2. The spindle 62 is of a circular cross-section of uniform diameter of which center is aligned with the pivot axis. The recess 10 is defined between opposite wall surfaces spaced by a distance equal to the diameter of the spindle 62 so that the spindle 62 is kept in rolling contact with the wall surfaces when the card 60 pivots about the pivot axis, thereby keeping the pivot axis at a fixed position and therefore assuring an accurate pivotal movement of the card 60. Further, the recess 16 has its top opened for introducing the spindle 62, facilitating the assembly of the card 60 to the base 1. As shown in FIGS. 5 and 6, the recess 16 is shaped to leave a clearance between the bottom of the recess and the spindle 62 in order to avoid undesired friction of the spindle 62 with the bottom of the recess, determining the pivot axis only at the interface between the pivot arm 61 and the top of the end wall 2 for accurately defining the pivot axis.

Figure 3:
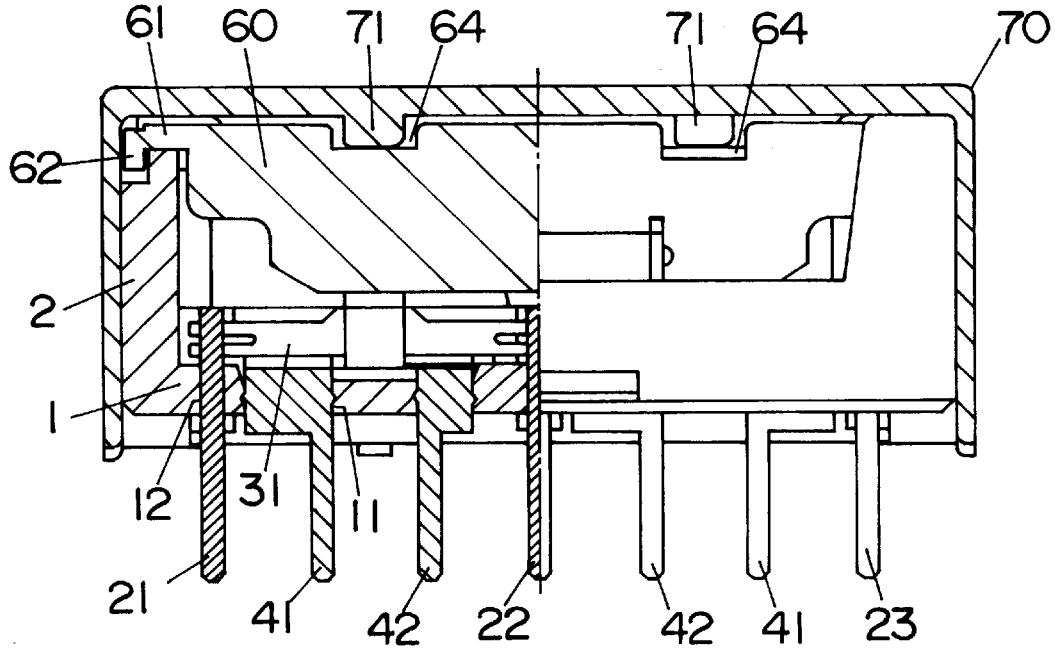
FIG. 3 is a front view, partly in section, of the relay.

As shown in FIGS. 1 and 3, the card 60 is also formed in its upper end with a pair of horizontally spaced pivot catches 64 for receiving therein corresponding projections 71 on the top interior surface of the cover 70. The pivot catch 64 has a rounded bottom which comes into contact with a flat end of the projection 71 for defining another pivot axis aligned with the pivot axis defined by the pivot arm 61, such that the card 60 can successfully and accurately pivots for contact opening and closing even when the relay is installed upside down.

Integrally depending from the lower end of the card 60 are a pair of horizontally spaced props 66 each supporting the longitudinal center of each of the movable contact springs 31 and 32. That is, the movable contact spring has its longitudinal center molded in the prop 66 to extend horizontally. The props 66 are also spaced in a direction of thickness so that the two movable contact springs 31 and 32 extend in parallel while being partially overlapped with respect to the length of the springs. It is noted in this connection that, as best shown in FIG. 2, the card 60 receives the biasing force from the return spring 68 at the same point with respect to the length of the card 60 as the armature 58 exerts a driving force to the card 60. Whereby, the card 60 can be free from torsional force which would otherwise impede the pivotal movement of the card, and therefore can make an accurate pivotal movement for reliable contact closing and opening.

Figure 10:
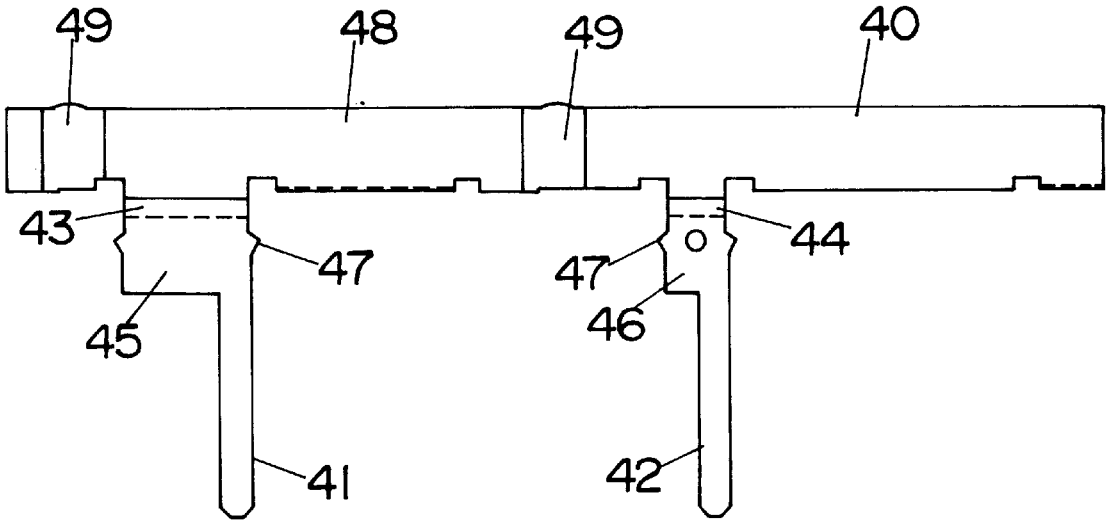
FIG. 10 is a front view of the shield plate.
Figure 11:
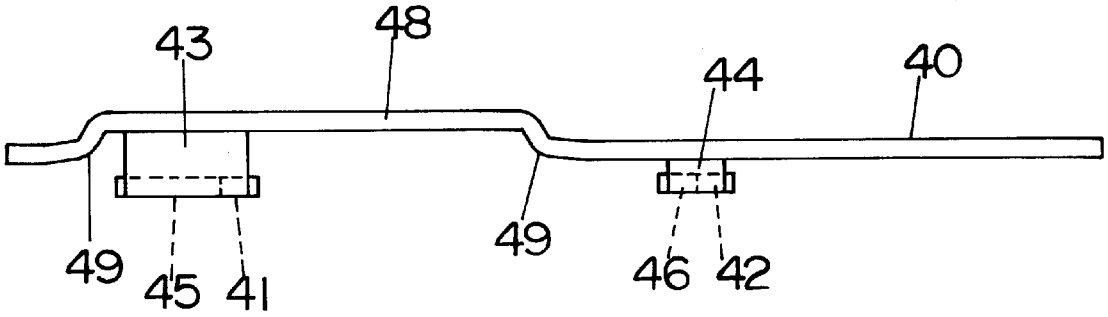
FIG. 11 is a top view of the shield plate.

The movable contact springs 31 and 32 as well as the three fixed contacts 24 to 26 are accommodated within a shielded space defined between the two shield plates 40 of identical configuration so as to be completely shielded without any interruption by the shield plates 40. Thus, the high frequency signal path extending between the COM contact 25 and NC contact 26 as well as between the COM contact 25 and the NO contact 24 through the corresponding movable contact spring 31, 32 is electromagnetically shielded between the two opposing shield plates 40 in a so-called strip-line shielding fashion. As shown in FIGS. 8 and 11, each shield plate 40 is shaped to have a bent recess 48 extending over about a half length of the plate and defining grounding shoulders 49 at opposite bent ends of the recess 48. The grounding shoulders 49 come into electrical contact respectively with opposite longitudinal ends of the movable contact spring 31, 32 moved to the contact opening position. Whereby, the movable contact spring in its contact open position has the same electrical potential as the shield plate 40. As shown in FIGS. 10 and 11, the shield plate 40 is shaped to have a pair of integral ground terminals 41 and 42 depending from the bottom of the plate in asymmetric relation about a longitudinal center the plate. That is, the one ground terminal 41 depends at a portion close to one longitudinal end of the plate, while the other ground terminal 42 depends at a portion close to the center of the plate. The shield plates 40 are assembled on the base 1 in such a way that the two ground terminals 41 and 42 of the one plate staggers with respect to the two ground terminals 41 and 42 of the other plate, as shown in FIG. 8. With this staggered arrangement of the ground terminals, it is readily possible to shorten a longer distance D between the one longitudinal end of the plate and the adjacent ground terminal down to 1/30 or less of a wavelength of the high frequency signal for eliminating a possibility of causing an undesired antenna effect therebetween, while using the two identical shield plates. This effect is easily confirmed when imaging a comparative case utilizing two identical shield plates each having the ground terminals on one half of its length.

Figure 9:
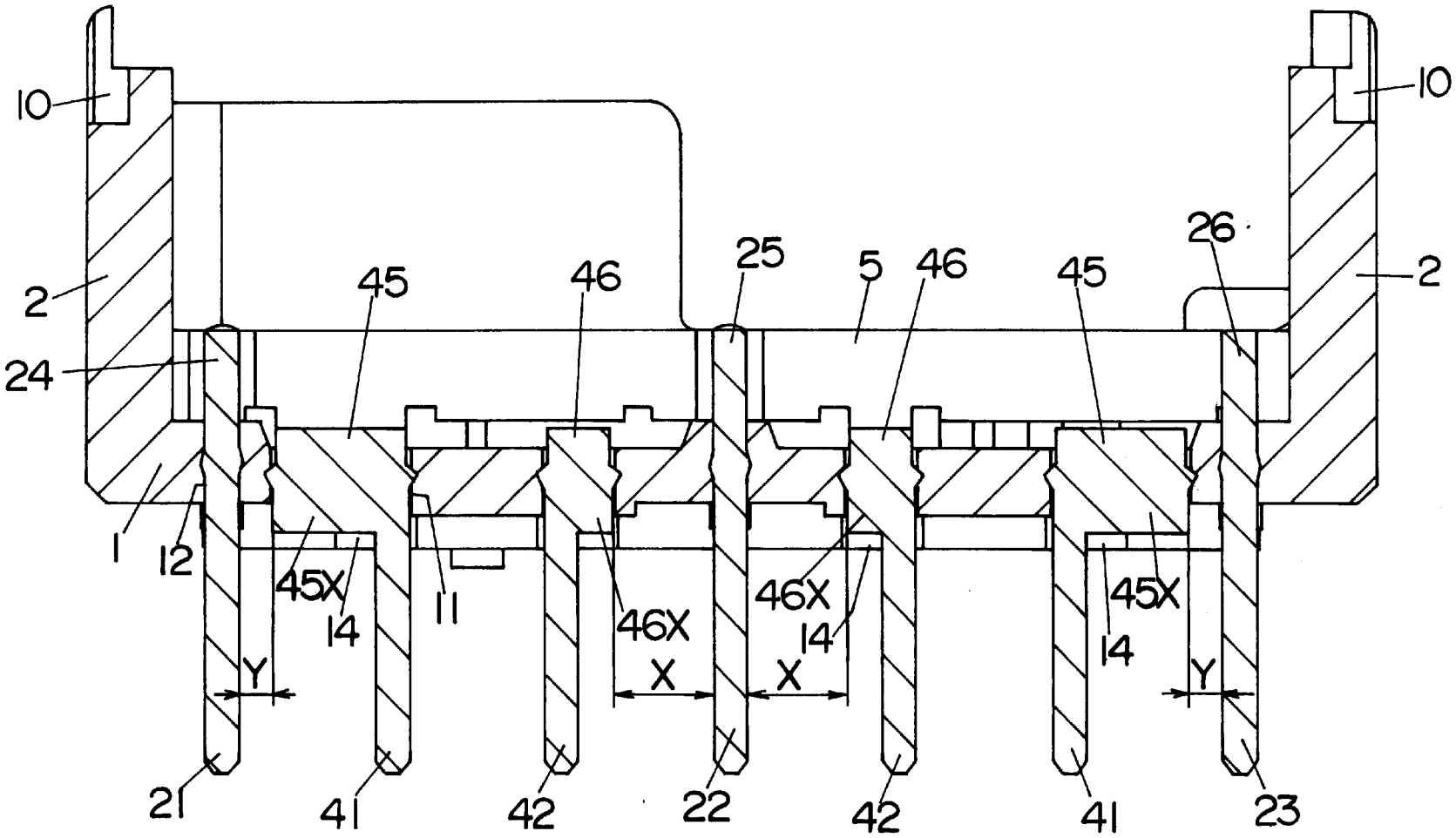
FIG. 9 is a front cross-section illustrating a shield plate and associated parts of the relay.

As shown in FIGS. 10 and 11, the ground terminals 41 and 42 extend respectively through ledges 43 and 44 and further through anchor sections 45 and 46 bent at a right angle to the ledges. The anchor sections 45 and 46 are press-fitted into corresponding slits 11 in the bottom of the base 1 for fixedly mounting the shield plate 40. For this purpose, each of the anchor sections 45 and 46 is provided on its opposite sides with barbs 47 engaging with the walls of the slit. The anchor sections 45 and 46 are shaped to have a width greater than that of the ground terminals 41 and 42 which are of the identical width and length, and each ground terminal depends from one width end of the corresponding anchor section so that the ground terminals and the contact terminals are uniformly spaced along the length of the base 1, as shown in FIG. 9. The contact terminals 21, 22 and 23 are of the same cross-section as the ground terminal and are press-fitted into slits 12 in the bottom of the base to be fixedly mounted to the base. Further, as shown in FIGS. 10 and 11, the one anchor section 45 adjacent to the one longitudinal end of the shield plate 40 has a width greater than the other anchor section 46 adjacent to the longitudinal center of the shied plate 40 such that, when the shield plates are mounted on the base, as shown in FIG. 9, the anchor sections 46 is spaced from the adjacent center contact terminal 22 of the COM contact 25 by a distance X greater than a distance Y by which the anchor sections 45 is spaced from the adjacent contact terminal 21 or 22 of the NO or NC contact. In this consequence, it is made to lessen a capacitance between the contact terminal 22 of the COM contact and the two adjacent ground terminals 42 than a capacitance between the contact terminal 21 or 23 of the NO or NC contact and the adjacent anchor section 45, thereby facilitating to achieve an impedance matching of the high frequency signal path to an intended overall impedance.

The base 1 is formed integrally with a pair of positioning studs 13 which project on the bottom of the compartment 7 at the longitudinal ends thereof for accurate positioning of the two opposing shield plates 40, i.e., keeping a constant spacing between the shield plates 40. When the shield plates 40 are mounted in the compartment 7 as being restricted on their back respectively by the partition 5 and the side wall 3 of the base 1, the longitudinal ends of each shield plate 40 abut against the positioning studs 13 for keeping the constant spacing therebetween and therefore giving a consistent high frequency characteristic to the signal path. In this connection, the partition 5 and the side wall 3 are provided respectively with stubs 4 and 6 which abut against the shield plates 40 at portions other than the back of the recess 48.

Figure 4:
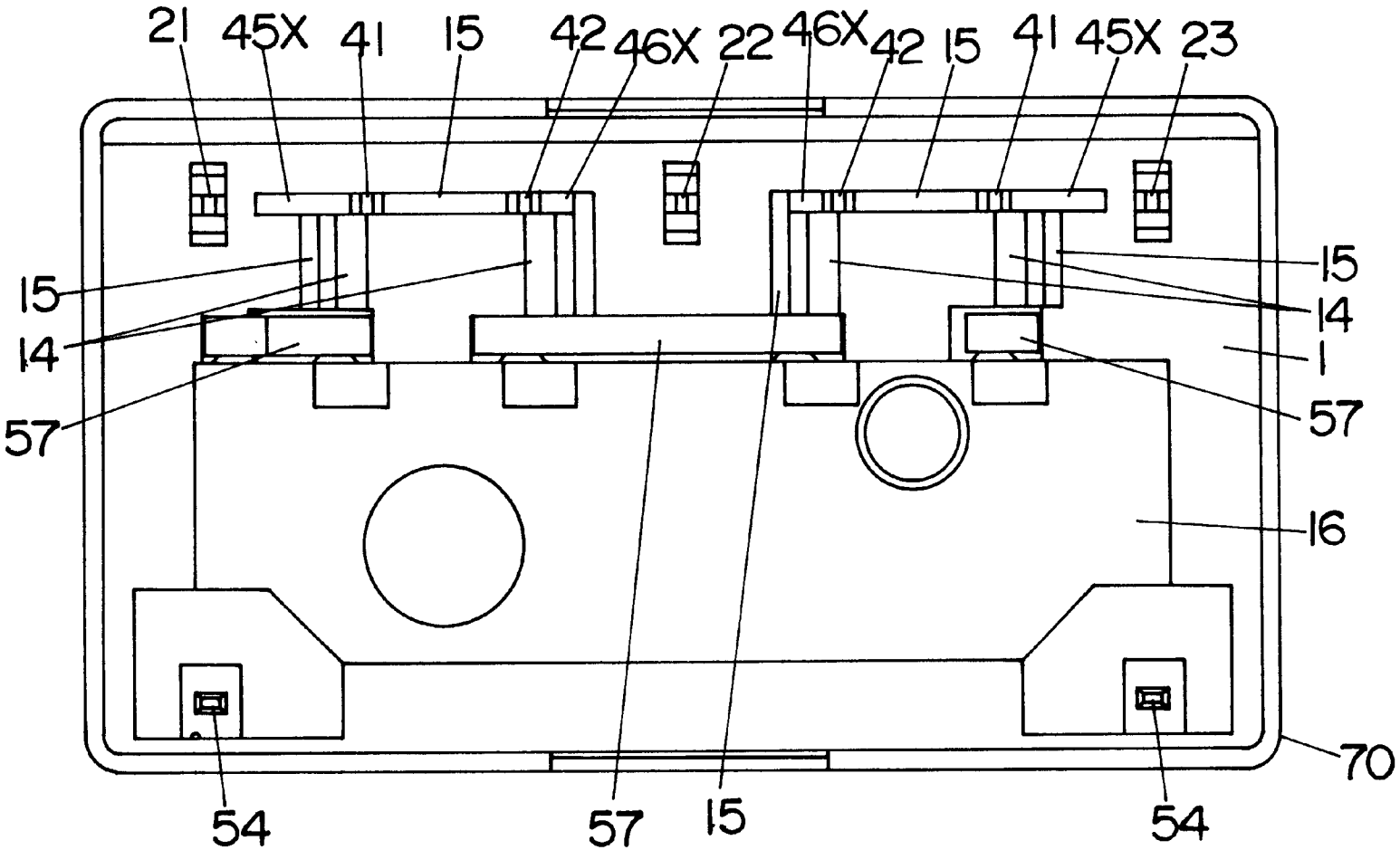
FIG. 4 is a bottom view of the relay.

As shown in FIG. 9, the anchor sections 45 and 46 of the ground terminals 41 and 42 project on the lower bottom of the base 1 to define respective shield extensions 45X and 46X for electrical connection with the yoke 56 on the lower bottom of the base 1. The yoke 56 made of an electrical conductive material is formed on its bottom with yoke extensions 57 which, as shown in FIG. 4, project on the lower bottom of the base 1 adjacent to the shield extensions 45X and 46X. Formed in the lower bottom of the base 1 are grooves 14 each extending between an adjacent pair of the yoke extension and the shield extension and receiving therein an electrically conductive adhesive filled for electrical connection between the extensions. The electrically conductive adhesive includes a silver paste to have a relatively low curing temperature of 100 to 160° C. Due to the electrical interconnection of the yoke 56 and the shield plates 40, the relay can exhibit good isolation particularly with respect to a high frequency signal of up to 500 MHz. In this connection, the yoke extension is electrically connected to the shield extension 45X, 46X immediately adjacent to the ground terminal 41, 42 for improving the isolation characteristic.

The grooves 14 are separated from the contact terminals 21, 22, and 23, as well as from the coil terminals 54 by means of barriers 15 and a bank 16 projecting on the bottom of the base 1, in addition to the shield extensions 45X and 46X. Thus, the adhesive filled in the grooves 14 can be successfully secluded from a sealing agent such as an epoxy resin filled around the contact terminals and the coil terminals. With this result, the adhesive can be applied concurrently with or immediately before the application of the sealing agent.

Figure 12:
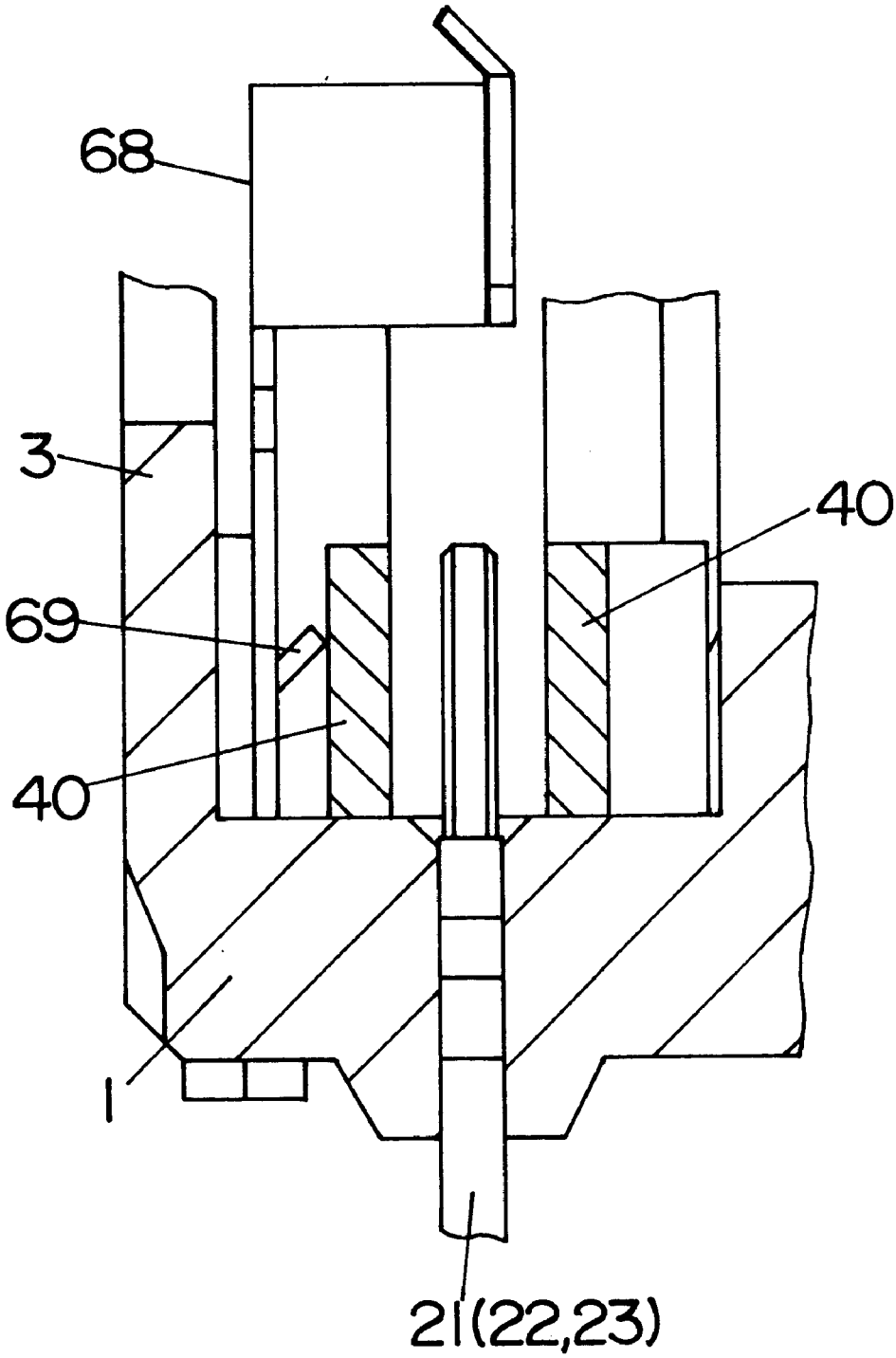
FIG. 12 is a sectional view illustrating an electrical connection of a return spring and the shield plate.
Figure 13:
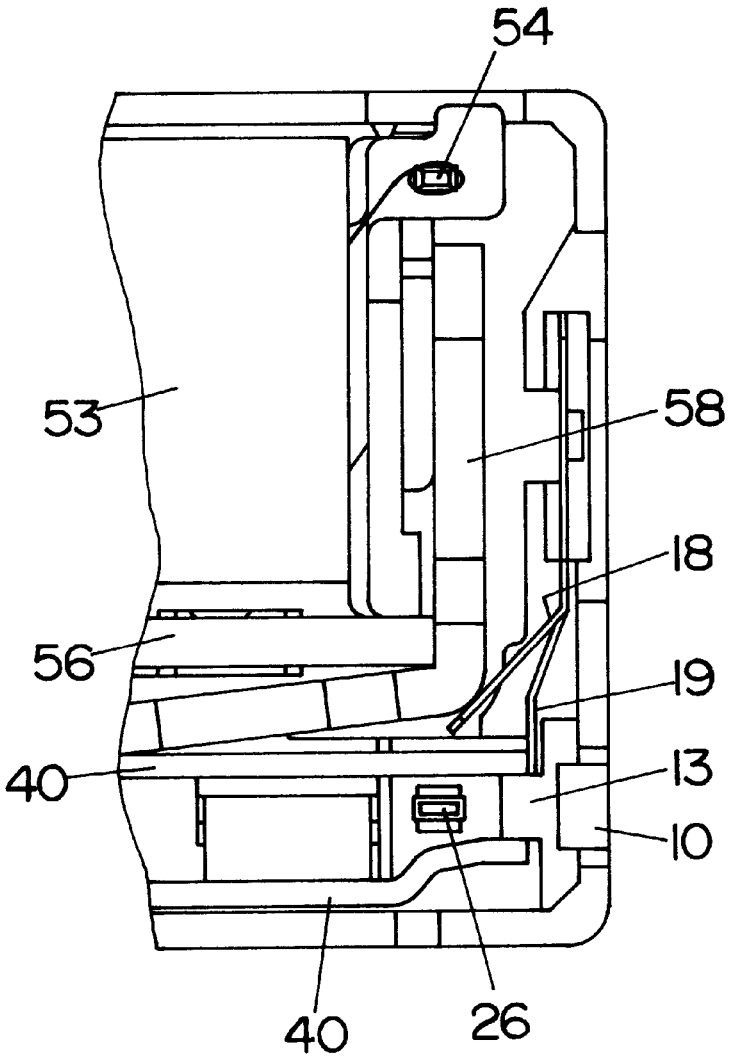
FIG. 13 is a partial top view illustrating an electrical connection of a retainer spring to the shield plate.

Further, as shown in FIG. 12, the return spring 68 made of an electrically conductive metal is electrically coupled to the shield plate 40, i.e., to the earth potential for improving the isolation characteristic of the relay. The electrical connection is established by means of an integral tab 69 which is struck out from a portion of the spring and is held in constant contact with the shield plate 40. Also for the same purpose, the retainer spring 18 of an electrically conductive metal may be coupled to the earth potential through the shield plate 40. For this purpose, the retainer spring 18 has an extension 19 for constant contact with the adjacent longitudinal end of the shield plate 40, as shown in FIG. 13.

Figure 14:
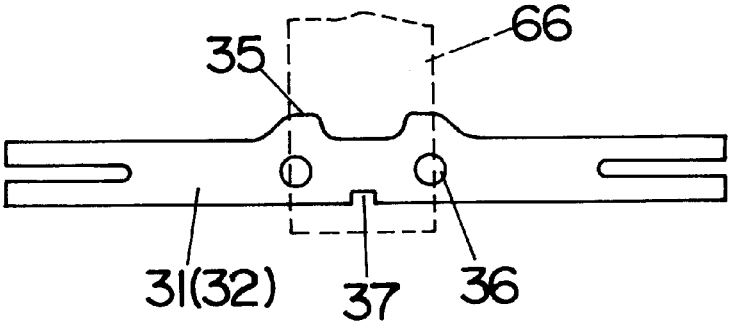
FIG. 14 is a front view of a movable contact spring utilized in the relay.
Figure 17:
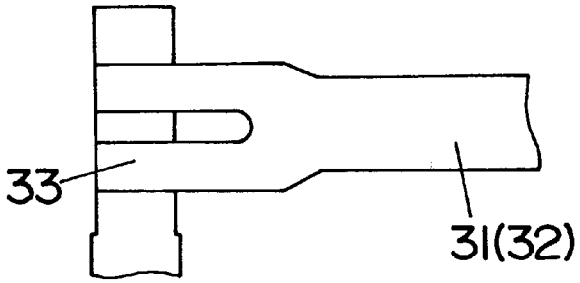
FIG. 17 is a partial top view illustrating a positional relation between one longitudinal end of the movable contact spring rested on the shield plate and a corresponding fixed contact in accordance with a modification of the above embodiment.

As shown in FIG. 14, the movable contact spring 31, 32 is shaped to have parallel upper and lower edges except for a longitudinal center portion of which major portion is molded in the prop 66 of the card 60. The center portion is shaped to have raised edges 35, holes 36, and a notch 37 in order to compensate for a difference in dielectric constant between the center portion molded in the prop and the other exposed portion of the movable contact spring, thereby facilitating to give the intended overall impedance of 50 Ω or 75 Ω to the high frequency signal path of the relay. Since the impedance matching is made only around the center portion molded in the prop 66, the movable spring can have the lower edge straight in parallel with the upper edge, thereby enabling to arrange the movable spring 31, 32 as close as possible to the base 1, which in turn contributes to reduce the height of the associated fixed contacts confined within the shield space for realizing good high frequency characteristic for the relay. As shown in FIG. 17, the movable contact spring 31, 32 may be shaped to have contact ends 33 of an increased width for stable and reliable contact with the associated fixed contacts in order to achieve a long operation life of the relay, taking an advantage of that minor shape differences at the longitudinal ends of the spring hardly affects the impedance of the spring.

Figure 15:
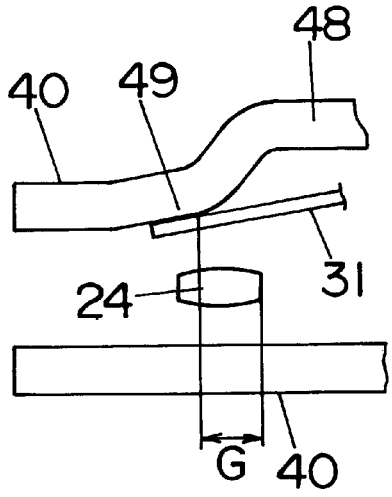
FIG. 15 is a partial front view of a modified movable contact spring which may be utilized in the above relay.

As shown in FIG. 15, the shield plate 40 is designed such that the shoulder 49 on which the movable spring 31, 32 rests are spaced longitudinally outwardly of an inner edge of the associated fixed contact 24 by a gap distance G. With this arrangement, the movable spring is held in the contact opening position while allowing the longitudinal ends thereof to warp towards the associated fixed contact only by a small extent for improving the isolation of the spring. In this connection, the shoulder 49 is shaped to have an inclined face for contact with the spring over a large area.

Figure 16:
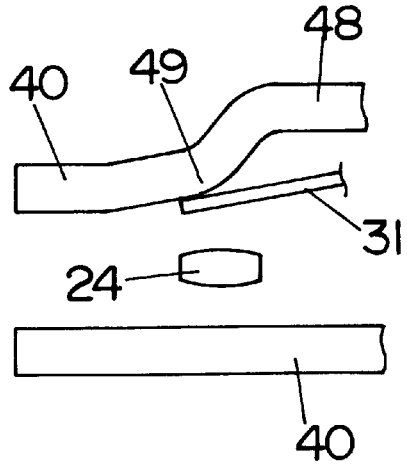
FIG. 16 is a partial top view illustrating a positional relation between one longitudinal end of the movable contact spring rested on the shield plate and a corresponding fixed contact.

Further, as shown in FIG. 16, the shield plate 40 may be designed such that the shoulder 49 comes into contact with the distal end of the movable contact spring 31, 32 at a location corresponding to an outer edge of the associated fixed contact 24 with respect to the length of the spring so as to minimize the warping of the distal end of the spring towards the associated fixed contact for further improving the isolation of the spring. Although FIGS. 15 and 16 show only one of the shoulders 49 of the shield plate 40, the other shoulder is arranged similarly in relation to the adjacent fixed COM or NO contact 25, 24.

What is claimed is:

1. A high frequency relay comprising:

a dielectric base mounting three fixed contacts defining a common (COM) contact, a normally-closed (NC) contact, and a normally-open (NO) contact, respectively, said NC and NO contacts being arranged on opposite of said COM contact, each of said fixed contacts being defined at a tip of each corresponding one of three contact terminals extending through said base;

a first movable contact spring bridging said COM contact and said NC contact for closing and opening a first high frequency signal path defined therebetween;

a second movable contact spring bridging said COM contact and said NO contact for closing and opening a second high frequency signal path defined therebetween;

a driving mechanism causing said first and second movable contact springs to move for closing and opening said first and second high frequency signal paths alternately;

a pair of electromagnetic shield plates upstanding from said base to define a shielded space between said shield plates for accommodating therein said three fixed contacts, said first movable contact spring, and said second movable contact spring, each of said shield plates being configured to come into electrical contact with corresponding one of said first and second movable contact springs moved in a contact opening position;

wherein each of said shield plates being integrally formed with at least one ground terminal which extends continuously from a bottom of said shield plate through said base, and each of said shied plates being configured to cover said first and second movable contact springs over the full length thereof without any interruption for completely shielding said first and second high frequency signal paths.

2. The relay as set forth in claim 1, wherein said shield plates are of the identical configuration.

3. The relay as set forth in claim 1, wherein a pair of positioning studs are molded integrally with said base to project thereon for abutting against opposite ends of said shield plates, respectively.

4. The relay as set forth in claim 1, wherein each of said shield plates is formed with a bent recess which defines grounding shoulders at opposite bent ends of said recess for contact with the opposite ends of each of said first and second movable contact springs, each said grounding shoulder being located outwardly of an inner edge of the corresponding fixed contacts with respect to a lengthwise direction of the corresponding movable contact spring.

5. The relay as set forth in claim 4, wherein the opposite ends of each movable contact springs are located at outer edges of the corresponding fixed contacts, respectively with respect to the lengthwise direction of said movable contact spring.

6. The relay as set forth in claim 2, wherein said shield plate has a pair of said ground terminals which are spaced along a length of said shield plate and positioned asymmetrically about a longitudinal center thereof so that the two ground terminals of the one shield plate stagger with the two ground terminals of the other shield plate with respect to a longitudinal direction of said shield plate.

7. The relay as set forth in claim 1, wherein said shield plate has a pair of said ground terminals which are spaced along a length of said shield plate and extend from the bottom of said shield plate through respective anchor sections, said anchor section being engaged with said base and having a greater width than said ground terminal with respect to a lengthwise direction of said shield plate, one of the anchor sections adjacent to the contact terminal of said COM contact being spaced therefrom by a distance (X) greater than a distance (Y) by which another of the anchor sections adjacent to the contact terminal of said NC or NO contact is spaced therefrom.

8. The relay as set forth in claim 1, wherein each of said first and second contact springs is formed at its opposite ends with contacting tips for contact with the corresponding fixed contacts, said contacting tips being wider than the remainder of the movable contact spring.

9. The relay as set forth in claim 1, wherein said driving mechanism includes an electromagnet, an armature, and a card carrying said first and second movable contact springs at its lower end, said armature moving in response to the excitation of said electromagnet for driving said card to open and close said first and second high frequency signal paths, said card being shaped in to an elongated configuration aligned along a length of said shield plates and located above s aid shield space, and said card being formed at its upper longitudinal ends with pivot arms which are pivotally supported on top of end walls upstanding from the opposite longitudinal ends of said base.

10. The relay as set forth in claim 9, wherein said card is also formed at its opposite longitudinal ends with retainer members which are engaged respectively with said end walls to retain said card at a correct position for defining a constant pivot axis about which said card pivots.

11. The relay as set forth in claim 9, wherein said pivot arm is configured to have a rounded fulcrum which rests on a flat surface on top of said end wall.

12. The relay as set forth in claim 10, wherein said retainer member is shaped into a spindle having a uniform diameter, said spindle being received in a bearing recess at the upper end of said end wall in rolling contact with opposite side walls of said bearing recess, said opposite side walls being spaced by a distance equal to the diameter of said spindle.

13. The relay as set forth in claim 9, further including a cover fitted over said base to enclose various components of said relay, said cover having a top wall of which interior surface is formed with at least one projection, said projection engaging into a pivot catch formed in said card for pivotally supporting said card and allowing the card to pivot for closing and opening said first and second high frequency signal paths.

14. The relay as set forth in claim 9, further including a return spring for urging said card in one direction of disengaging said second movable contact spring away form said COM contact and said NO contact, said return spring abutting at its one end against said card at the same point along the length of said card as said armature abutting against the card for causing said card to pivot.

15. The relay as set forth in claim 1, wherein each of said contact terminals and said ground terminals is capable of being bent at a bent point outwardly of the base for enabling the relay to be surface mounted on a circuit board with a bent portion soldered on the circuit board, each of said contact terminals and said ground terminals being shaped to have the same cross section from said bent point towards the lower end away from the base, said ground terminal extending from the bottom of said shield plate through an anchor section, said anchor section being engaged with said base and having a greater width than said ground terminal with respect to a lengthwise direction of said shield plate, and said anchor section being bent at a right angle from the bottom of the shield plate to extend vertically downwardly therefrom.

16. The relay as set forth in claim 1, wherein each of said first and second movable contact springs has a section of which shape is different from that of the remainder of said movable contact spring for making impedance matching of said first and second high frequency signal paths.

17. The relay as set forth in claim 16, wherein each of said first and second movable contact springs has its lengthwise center portion embedded within a prop which is molded from a plastic material to depend from a card, said movable contact spring being shaped to have a uniform thickness and width except for the lengthwise center portion which defines said section responsible for making the impedance matching.

18. The relay as set forth in claim 17, wherein said movable contact spring is shaped to have straight upper and lower edges except for said lengthwise center portion, said lengthwise center portion being shaped to have a raised upper edge to increase the width of said lengthwise center portion.

19. The relay as set forth in claim 9, wherein said electromagnet comprises an excitation coil wound around a center core, and a yoke disposed outwardly of the coil to establish a magnetic flux path together with said armature, said yoke having a yoke extension projecting on the bottom surface of said base, and said shield plate having a shield extension projecting on the bottom of said base for electrical connection with said yoke extension on the bottom of said base.

20. The relay as set forth in claim 19, wherein said shield extension is formed closely adjacent to said ground terminal.

21. The relay as set forth in claim 19, wherein said shield extension is electrically connected to said yoke extension by means of an electrically conductive adhesive.

22. The relay as set forth in claim 21, wherein said base is formed with grooves extending between said shield extension and said yoke extension for receiving said electrically conductive adhesive.

23. The relay as set forth in claim 22, wherein said base is formed with barriers projecting on the bottom of the base to separate said grooves from said contact terminals for secluding said electrically conductive adhesive filled in said groove from a sealing agent filled around said contact terminals.

24. The relay as set forth in claim 21, wherein said electrically conductive adhesive includes a silver paste.

* * * * *

UNITED STATES PATENT AND TRADEMARK OFFICE

CERTIFICATE OF CORRECTION

PATENT NO. : 6,329,891 B1
DATED : December 11, 2001
INVENTOR(S) : Takatoshi Hayashi et al.

It is certified that error appears in the above-identified patent and that said Letters Patent is hereby corrected as shown below:

Title page,
Item [75], Inventors correct to read: -- [75] Inventors: Takatoshi Hayashi, Suzuka; Atsushi Nakahata, Matsusaka; Takuji Yamashita, Higashiosaka; Hidetoshi Takeyama, Hisai; Koji Sagawa, Tsu; Tetsuya Yamada; Tomohiro Taguchi, Both of Watari-gun; Hisao Yabu, Osaka, all of (JP) --

Signed and Sealed this

Thirtieth Day of July, 2002

*Attest:*

*Attesting Officer*

JAMES E. ROGAN
*Director of the United States Patent and Trademark Office*